US009199425B2

(12) United States Patent
Yamaguchi

(10) Patent No.: US 9,199,425 B2
(45) Date of Patent: Dec. 1, 2015

(54) RECORDING MEDIUM PROCESSING APPARATUS, RECORDING MEDIUM PROCESSING SYSTEM, AND NON-TRANSITORY COMPUTER READABLE MEDIUM FOR SETTING A FOLDING POSITION FOR A RECORDING MEDIUM

(71) Applicant: FUJI XEROX CO., LTD., Minato-ku, Tokyo (JP)

(72) Inventor: Masahiro Yamaguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 76 days.

(21) Appl. No.: 14/049,747

(22) Filed: Oct. 9, 2013

(65) Prior Publication Data

US 2014/0255127 A1 Sep. 11, 2014

(30) Foreign Application Priority Data

Mar. 6, 2013 (JP) ..... 2013-043997

(51) Int. Cl.

| | |
|---|---|
| ***B65H 37/06*** | (2006.01) |
| ***B31D 1/00*** | (2006.01) |
| ***B65H 45/28*** | (2006.01) |
| ***B42C 9/00*** | (2006.01) |
| ***B42C 19/02*** | (2006.01) |

(52) U.S. Cl.

CPC ..... *B31D 1/00* (2013.01); *B42C 9/0006* (2013.01); *B42C 19/02* (2013.01); *B65H 45/28* (2013.01); *B65H 2801/27* (2013.01)

(58) Field of Classification Search

CPC ..... B65H 37/06
USPC ..... 270/32, 37, 45; 399/408
See application file for complete search history.

(56) References Cited

U.S. PATENT DOCUMENTS

| | | | | |
|---|---|---|---|---|
| 7,765,537 | B2 * | 7/2010 | Havin et al. | 717/166 |
| 7,907,887 | B2 * | 3/2011 | Asai et al. | 399/407 |
| 7,946,565 | B2 * | 5/2011 | Kubota et al. | 270/39.01 |
| 8,437,687 | B2 * | 5/2013 | Chowdry et al. | 399/408 |
| 2012/0153555 | A1 * | 6/2012 | Akashi | 270/45 |

FOREIGN PATENT DOCUMENTS

| | | | |
|---|---|---|---|
| JP | 2008037057 | A | 2/2008 |
| JP | 2008-193669 | A | 8/2008 |
| JP | 2008247533 | A | 10/2008 |
| JP | 2011170872 | A | 9/2011 |

OTHER PUBLICATIONS

Communication dated Jul. 13, 2015 from the Japanese Patent Office in counterpart application No. 2013-043997.

* cited by examiner

*Primary Examiner* — Patrick Mackey
(74) *Attorney, Agent, or Firm* — Sughrue Mion, PLLC

(57) ABSTRACT

A recording medium processing apparatus includes a folding position setting unit. The folding position setting unit sets, on the basis of a cutting position at which a recording medium is to be cut, a folding position at which the recording medium is to be folded.

8 Claims, 13 Drawing Sheets

RECORDING MEDIUM PROCESSING APPARATUS, RECORDING MEDIUM PROCESSING SYSTEM, AND NON-TRANSITORY COMPUTER READABLE MEDIUM FOR SETTING A FOLDING POSITION FOR A RECORDING MEDIUM

CROSS-REFERENCE TO RELATED APPLICATIONS

This application is based on and claims priority under 35 USC 119 from Japanese Patent Application No. 2013-043997 filed Mar. 6, 2013.

BACKGROUND

Technical Field

The present invention relates to a recording medium processing apparatus, a recording medium processing system, and a non-transitory computer readable medium.

SUMMARY

According to an aspect of the invention, there is provided a recording medium processing apparatus including a folding position setting unit. The folding position setting unit sets, on the basis of a cutting position at which a recording medium is to be cut, a folding position at which the recording medium is to be folded.

BRIEF DESCRIPTION OF THE DRAWINGS

Exemplary embodiments of the present invention will be described in detail based on the following figures, wherein:

FIG. 6A is an elevational view illustrating an example of recording media to be cut by the binding apparatus, FIG. 6B is an elevational view illustrating an example in which a sheet among the recording media is z-folded, FIG. 6C is a plan view illustrating an example in which the sheet is z-folded at predetermined folding positions, and FIG. 6D is a plan view illustrating an example in which the sheet is z-folded at modified folding positions;

FIG. 7A illustrates a reference shape, FIG. 7B illustrates an elevational view of the sheet, and FIG. 7C illustrates a plan view of the sheet;

FIG. 8A is an elevational view illustrating an example of recording media to be cut, FIG. 8B is an elevational view illustrating an example in which a sheet is z-folded, FIG. 8C is a plan view illustrating an example in which the sheet is z-folded at predetermined folding positions, and FIG. 8D is a plan view illustrating an example in which the sheet is z-folded after the first folding position alone is modified;

FIG. 9A is an elevational view illustrating an example of recording media to be cut, FIG. 9B is an elevational view illustrating an example in which a sheet is bi-folded, FIG. 9C is a plan view illustrating an example in which the sheet is bi-folded at a predetermined folding position, and FIG. 9D is a plan view illustrating an example in which the sheet is bi-folded at a modified folding position;

FIG. 12A illustrates a comparative example, in contrast with fold marks printed in the second exemplary embodiment, and FIG. 12B illustrates an example of fold marks printed in the second exemplary embodiment.

DETAILED DESCRIPTION

Exemplary embodiments of the present invention will be described in detail below with reference to the drawings.

Figure 1:
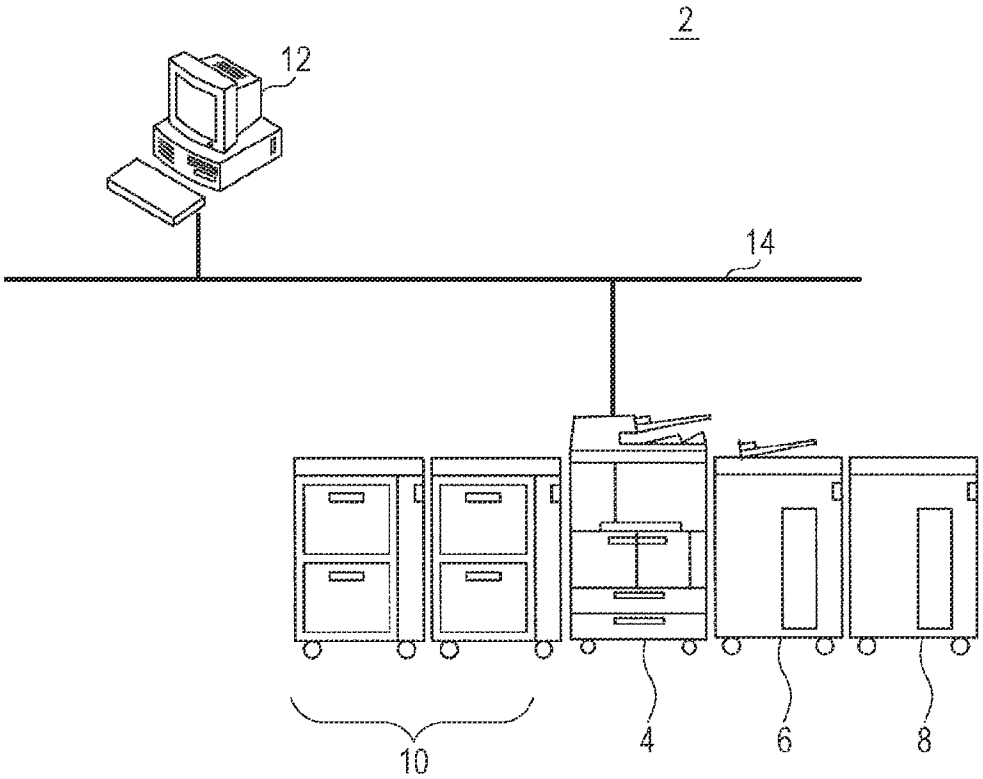
FIG. 1 is a schematic diagram of a recording medium processing system according to a first exemplary embodiment of the present invention.

FIG. 1 is a schematic diagram of a recording medium processing system 2 according to a first exemplary embodiment of the present invention.

The recording medium processing system 2 according to the first exemplary embodiment of the present invention includes multiple recording medium processing apparatuses each of which performs processing on recording media. Specifically, as illustrated in FIG. 1, the recording medium processing system 2 includes an image forming apparatus 4, a recording medium folding apparatus 6 and a binding apparatus 8 which are post-processing apparatuses sequentially connected to the image forming apparatus 4, a sheet feeding apparatus 10, and a terminal apparatus 12. The image forming apparatus 4 and the terminal apparatus 12 are connected to each other via a network 14.

The terminal apparatus 12 generates print data and transmits the generated print data to the image forming apparatus 4 via the network 14. The sheet feeding apparatus 10 feeds a recording medium, such as a sheet, to the image forming apparatus 4. The image forming apparatus 4 receives print data transmitted from the terminal apparatus 12 and outputs an image based on the print data on a recording medium. The image forming apparatus 4 also includes an image reading apparatus (not illustrated), such as a scanner, that reads an image from an original document and outputs the image read by this image reading apparatus on a recording medium. Note that the image forming apparatus 4 may be configured to print images based on print data generated by a user interface (UI) device 38 (described later) included therein in addition to print data transmitted from the terminal apparatus 12.

The recording medium folding apparatus 6 has a function of folding, in accordance with a specified folding style, a recording medium on which an image has been formed by the image forming apparatus 4. The binding apparatus 8 has a function of binding a set of recording media on which images have been formed by the image forming apparatus 4. Here, the process of binding includes cutting.

Note that a description will be given in the first exemplary embodiment on the assumption that the binding apparatus 8 performs case binding on a set of recording media which have a predetermined thickness or less. The predetermined thickness is, for example, the upper-limit thickness permitted in binding performed by a binding processing mechanism unit 58 (described later).

Figure 2:
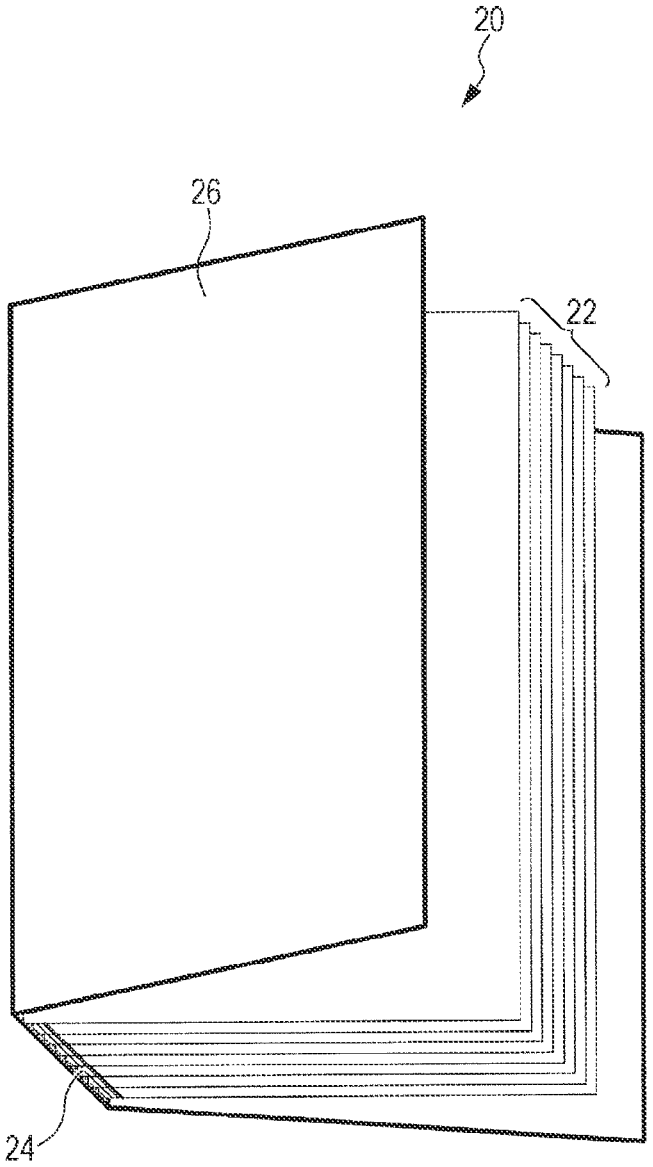
FIG. 2 is a perspective view illustrating an example of a booklet obtained as a result of case binding performed by a binding apparatus.

FIG. 2 is a perspective view illustrating an example of a booklet obtained as a result of case binding performed by the binding apparatus 8.

As illustrated in FIG. 2, during case binding, the binding apparatus 8 applies an adhesive to a spine part 24 that is edges of inner sheets 22, i.e., a set of recording media contained in a booklet 20, so as to adhere the spine part 24 to a recording medium constituting a cover 26. The binding apparatus 8 according to the first exemplary embodiment also cuts the recording media.

Figure 3:
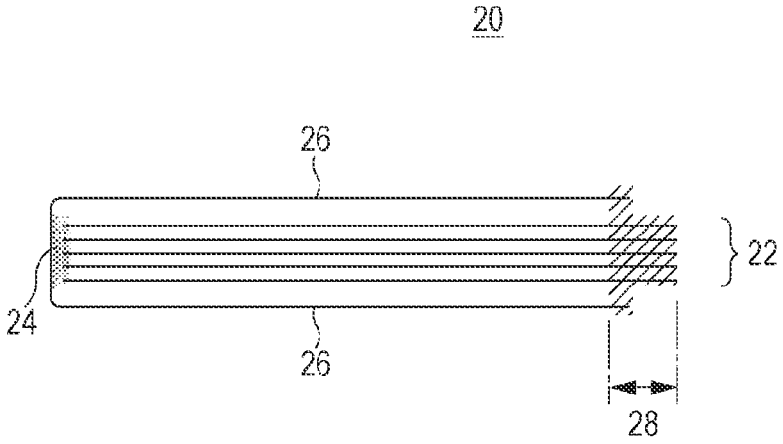
FIG. 3 is a plan view illustrating an area to be cut by the binding apparatus.

FIG. 3 is a plan view illustrating an area to be cut by the binding apparatus 8. During case binding, binding is performed in such a manner that a set of recording media having a second size are covered by a recording medium having a first size. For example, in the case where the cover is twice as large as the inner sheets, such as in the case where A4-size inner sheets are covered by an A3-size cover, the inner sheets 22 are not completely covered by the cover 26 as illustrated in FIG. 3. Consequently, the inner sheets 22 protrude from the cover 26. In such a case, a to-be-cut area 28 illustrated in FIG. 3 is cut off from the recording media in order to trim the booklet 20.

Note that the width to be cut off may be predetermined or may be determined on the basis of the thickness of the inner sheets 22 covered by the cover 26. Although FIG. 3 illustrates an example in which both the cover 26 and the inner sheets 22 are cut, the inner sheets 22 alone may be cut. Cutting may be performed regardless of whether or not the inner sheets 22 protrude from the cover 26. Cutting may be performed at the upper and lower edges of the booklet 20 in addition to the edge (end) opposite to the spine part 24 of the booklet 20.

Figure 4:
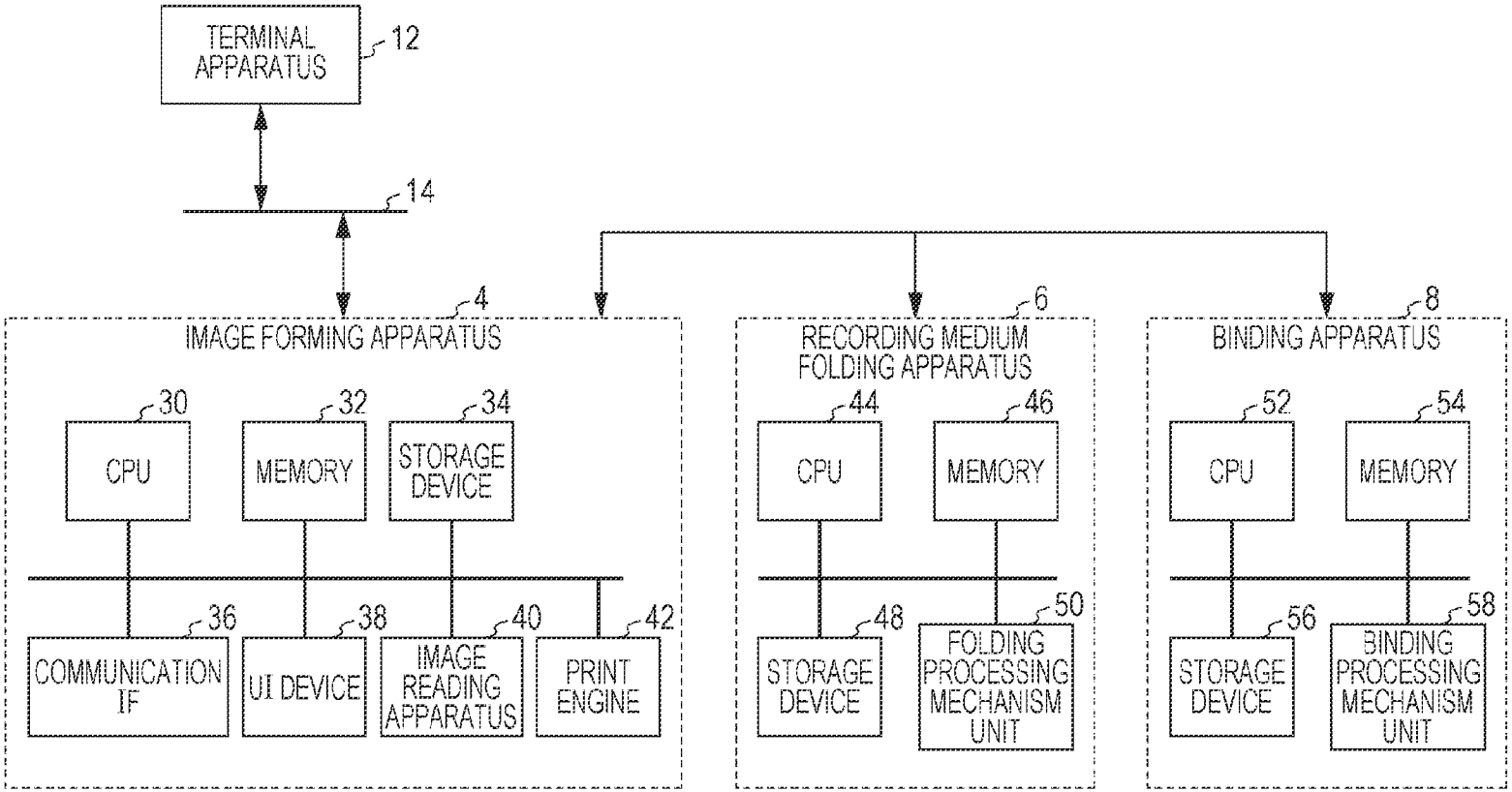
FIG. 4 is a block diagram illustrating the hardware configurations of an image forming apparatus, a recording medium folding apparatus, and the binding apparatus included in the recording medium processing system according to the first exemplary embodiment.

Next, FIG. 4 illustrates the hardware configurations of the image forming apparatus 4, the recording medium folding apparatus 6, and the binding apparatus 8 included in the recording medium processing system 2 according to the first exemplary embodiment.

As illustrated in FIG. 4, the image forming apparatus 4 includes a central processing unit (CPU) 30, a memory 32, a storage device 34 such as a hard disk drive (HDD), a communication interface (IF) 36 that transmits and receives data to and from an external apparatus or the like via the network 14, the UI device 38 including a touch screen or a liquid crystal display and a keyboard, an image reading apparatus 40 such as a scanner, and a print engine (corresponding to a printing mechanism) 42.

The CPU 30 executes processes in accordance with control programs stored in the memory 32 or the storage device 34 so as to control operation of the image forming apparatus 4.

Although the description is given on the assumption that the CPU 30 reads and executes the control programs stored in the memory 32 or the storage device 34 in the first exemplary embodiment, the programs may be stored on a recording medium, such as a Compact Disc-Read Only Memory (CD-ROM), and may be provided to the CPU 30.

Also, as illustrated in FIG. 4, the recording medium folding apparatus 6 includes a CPU 44, a memory 46, a storage device 48 such as an HDD, and a folding processing mechanism unit 50.

The folding processing mechanism unit 50 folds, in accordance with a specified folding style, a recording medium specified from among recording media that have been transported from the image forming apparatus 4. Note that the folding processing mechanism unit 50 may fold a recording medium placed on a tray (not illustrated) in addition to a recording medium that has been transported from the image forming apparatus 4.

The CPU 44 executes processes in accordance with control programs stored in the memory 46 or the storage device 48 so as to control operation of the recording medium folding apparatus 6.

Although the description is given on the assumption that the CPU 44 reads and executes the control programs stored in the memory 46 or the storage device 48 in the first exemplary embodiment, the programs may be stored on a recording medium, such as a CD-ROM, and may be provided to the CPU 44.

Also, as illustrated in FIG. 4, the binding apparatus 8 includes a CPU 52, a memory 54, a storage device 56 such as an HDD, and the binding processing mechanism unit 58.

The binding processing mechanism unit 58 performs a specified type of binding on recording media that have been transported from the recording medium folding apparatus 6. In the first exemplary embodiment, the binding processing mechanism unit 58 also performs cutting described above. Note that the binding processing mechanism unit 58 may perform binding on recording media placed on a tray (not illustrated) in addition to recording media that have been transported from the recording medium folding apparatus 6.

The CPU 52 executes processes in accordance with control programs stored in the memory 54 or the storage device 56 so as to control operation of the binding apparatus 8.

Although the description is given on the assumption that the CPU 52 reads and executes the control programs stored in the memory 54 or the storage device 56 in the first exemplary embodiment, the programs may be stored on a recording medium, such as a CD-ROM, and may be provided to the CPU 52.

Now, details of the recording medium folding apparatus 6 will be described.

Figure 5:
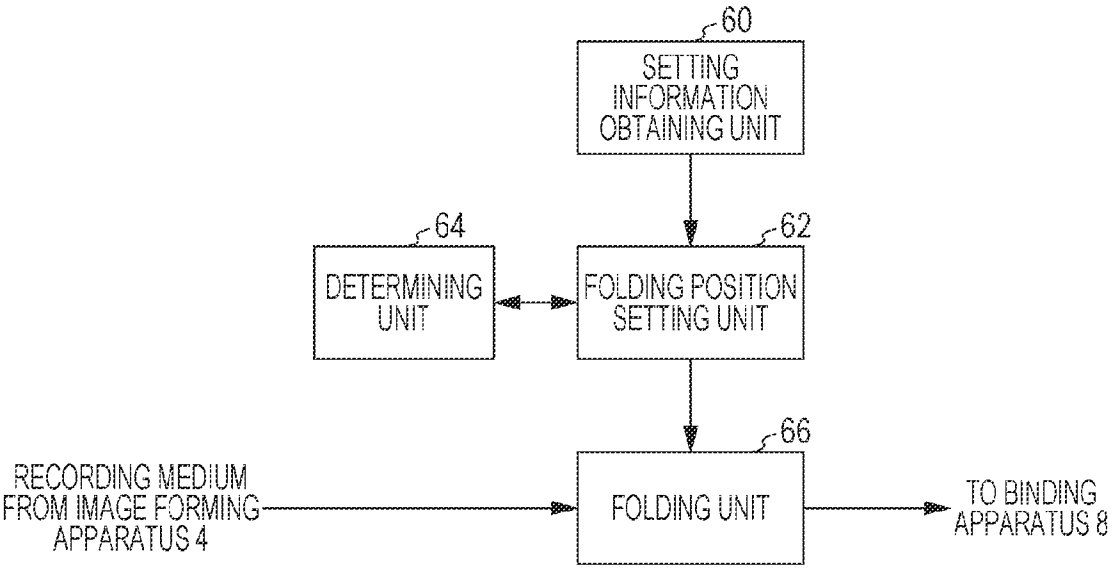
FIG. 5 is a block diagram illustrating the functional configuration of the recording medium folding apparatus, the functional configuration being implemented as a result of execution of a control program.

FIG. 5 is a block diagram illustrating the functional configuration of the recording medium folding apparatus 6, the functional configuration being implemented as a result of execution of a control program. Note that the configuration illustrated in FIG. 5 may be entirely or partially implemented by hardware, such as an application specific integrated circuit (ASIC) or field programmable gate array (FPGA).

As illustrated in FIG. 5, the recording medium folding apparatus 6 includes a setting information obtaining unit 60, a folding position setting unit 62, a determining unit 64, and a folding unit 66.

The setting information obtaining unit 60 obtains cutting position information used by the binding apparatus 8 during cutting. During cutting, a shape of a predetermined size, e.g., A4 size, is cut in accordance with a specified cutting position. Hereinafter, this shape of the predetermined size to be cut during cutting may be referred to as a reference shape. The cutting position information specifies the cutting position, and thus may be information about the width to be cut off from the reference shape or about the finished size (the size of the shape that is not cut off from the reference shape and remains after cutting). For example, the cutting position information may be information about the width to be cut off from an end of the A4-size shape or the finished size obtained from the A4-size shape.

The setting information obtaining unit 60 may also obtain information that specifies a recording medium to be folded among recording media transported from the image forming apparatus 4.

The setting information obtaining unit 60 may obtain information from the terminal apparatus 12 or from the UI device 38.

The folding position setting unit 62 sets a folding position of each recording medium in accordance with the cutting position obtained by the setting information obtaining unit 60. Specifically, the folding position setting unit 62 modifies, on the basis of the cutting position for the reference shape, a folding position at which a recording medium is to be folded in a predetermined folding style (for example, z-fold) into the reference shape, to a position on the recording medium not to be removed by cutting based on this cutting position.

In the first exemplary embodiment, if the determining unit 64 (described later) determines that the folding position need not be modified, the folding position setting unit 62 instructs the folding unit 66 (described later) to fold the recording medium at a predetermined folding position based on the folding style. On the other hand, if the determining unit 64 (described later) determines that the folding position needs to be modified, the folding position setting unit 62 modifies the predetermined folding position based on the folding style on the basis of the cutting position, and instructs the folding unit 66 to fold the recording medium at the modified folding position.

The determining unit 64 determines whether or not the predetermined folding position based on the folding style needs to be modified. Specifically, the determining unit 64 determines whether or not the folding position which is predetermined for the folding style and at which the recording medium is to be folded is within an area to be removed by cutting. If the folding position is located within an area to be removed by cutting, the predetermined folding position needs to be modified. If the folding position is located within an area not to be removed by cutting, the predetermined folding position need not be modified.

The folding unit 66 controls the folding processing mechanism unit 50 to fold a recording medium at a folding position set by the folding position setting unit 62. Note that in the first exemplary embodiment the folding unit 66 z-folds a recording medium. If the determining unit 64 determines that the predetermined folding positions based on the folding style need not be modified, the folding unit 66 folds, for example, an A3-size recording medium at predetermined folding positions corresponding to z-folding. If the determining unit 64 determines that the predetermined folding positions based on the folding style need to be modified, the folding unit 66 folds, for example, an A3-size recording medium not at the predetermined folding positions corresponding to z-folding but at folding positions that have been modified by the folding position setting unit 62. Note that the folding unit 66 may be configured to perform folding of other styles, such as bi-folding, in addition to z-folding.

Figure 6A:
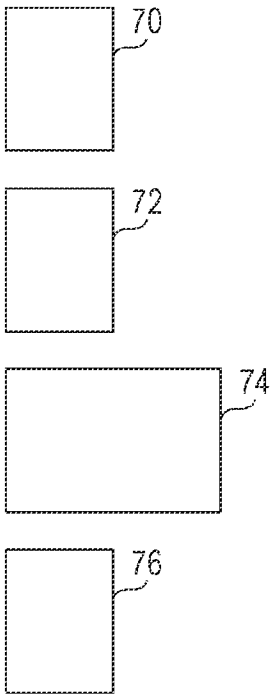
FIGS. 6A to 6D are schematic diagrams for describing an example of how folding positions are modified by a folding position setting unit, specifically.
Figure 6B:
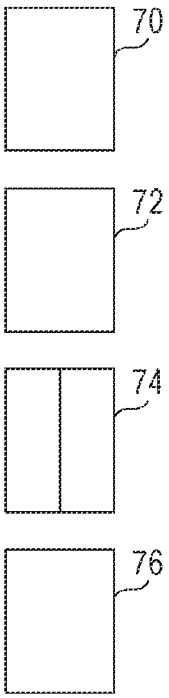
Figure 6C:
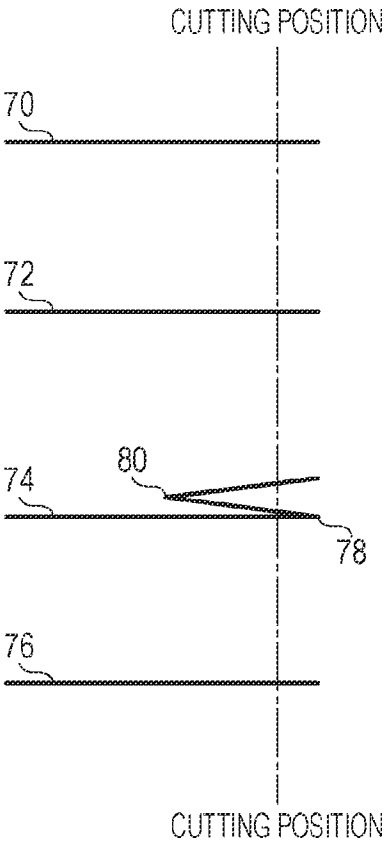
Figure 6D:
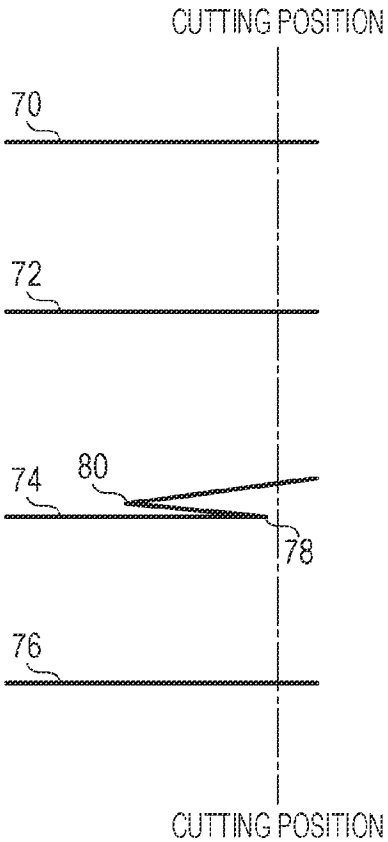

FIGS. 6A to 6D are schematic diagrams for describing an example of how folding positions are modified by the folding position setting unit 62. Specifically, FIG. 6A is an elevational view illustrating an example of recording media to be cut by the binding apparatus 8. FIG. 6B is an elevational view illustrating an example in which a sheet 74 among the recording media is z-folded. FIG. 6C is a plan view illustrating an example in which the sheet 74 is z-folded at predetermined folding positions. FIG. 6D is a plan view illustrating an example in which the sheet 74 is z-folded at modified folding positions.

As illustrated in FIGS. 6A and 6B, the case where the sheet 74 among sheets 70 to 76 is z-folded is taken as an example. It is assumed that the sheets 70 to 76 are to be collectively bound at the left edges thereof in the figures. Also, as illustrated in FIGS. 6C and 6D, it is assumed that the sheet 74 is z-folded in such a manner that the right side of the sheet 74 is folded toward the left side.

As illustrated in FIG. 6C, the sheet 74 is valley-folded at a first folding position 78 (which is predetermined and is located halfway along the horizontal length of the sheet 74 in the example illustrated in FIGS. 6A to 6D) and at a second folding position 80 (which is predetermined and is spaced apart from the right end of the sheet 74 by a quarter of the horizontal length of the sheet 74 in the example illustrated in FIGS. 6A to 6D).

In this case, the first folding position 78 is included in an area to be removed by cutting. Thus, when the sheet 74 is cut at a cutting position illustrated in FIG. 6C, the sheet 74 is divided into multiple pieces and is partially removed.

If the predetermined folding position, which is based on the folding style, at which a recording media is to be folded is within an area to be removed by cutting in this manner, the determining unit 64 determines that the folding position needs to be modified and the folding position setting unit 62 modifies the folding position.

The folding position setting unit 62 modifies the first folding position 78 to a position in an area not to be removed by cutting as illustrated in FIG. 6D.

Figure 7A:
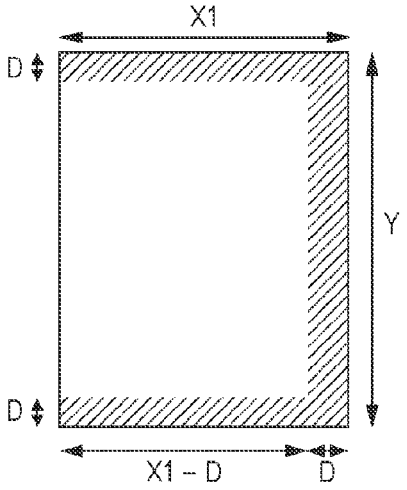
FIGS. 7A to 7C are schematic diagrams illustrating an example of how the modified folding positions of z-folding are calculated, specifically.
Figure 7B:
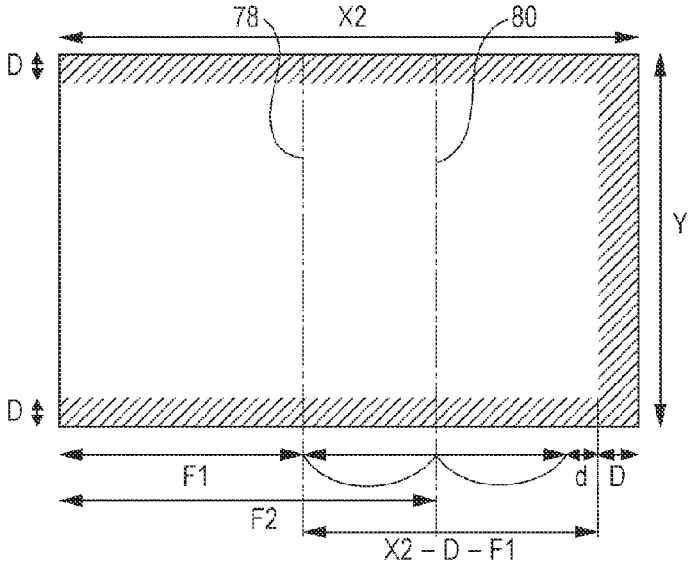
Figure 7C:
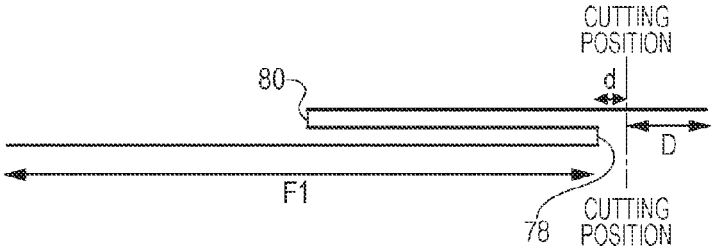

FIGS. 7A to 7C are schematic diagrams illustrating an example of how the modified folding positions of z-folding are calculated. Specifically, FIG. 7A illustrates a reference shape (for example, an A4-size shape) to be cut. A hatched area denotes an area to be cut off from the reference shape. The horizontal and vertical lengths of the reference shape are X1 and Y, respectively. An area having a width D from each of three edges of the reference shape is set as the to-be-cut area 28.

FIGS. 7B and 7C illustrate, for example, the A3-size sheet 74 that is illustrated in FIGS. 6A to 6D and is to be z-folded by the folding unit 66. FIG. 7B illustrates an elevational view of the sheet 74. Dot-and-dash lines in the figure denote modified folding positions (the first folding position 78 and the second folding position 80) obtained as a result of the predetermined folding positions based on the folding style being modified by the folding position setting unit 62. A hatched area in the figure denotes the area to be removed when cutting illustrated in FIG. 7A is performed on the z-folded sheet 74. FIG. 7C illustrates a plan view of the sheet 74.

Referring to FIGS. 7B and 7C, X2 denotes the horizontal length of the sheet 74 and Y which is equal to that of the reference shape denotes the vertical length of the sheet 74. F1 denotes the length from the left end of the sheet 74 to the first folding position 78 and F2 denotes the length from the left end of the sheet 74 to the second folding position 80.

Here, the folding position setting unit 62 sets, as the modified folding positions of the predetermined folding positions, F1 and F2 in the following manner, for example.

First, as illustrated in FIG. 7A, the horizontal finished size is "X1−D". Thus, F1 needs to be equal to "X1−D" or smaller. For example, the folding position setting unit 62 sets a length d as a margin, and sets F1 to be equal to "X1−D−d". Note that the length d may be determined on the basis of cutting preciseness or the like.

The horizontal length of the sheet 74 remaining after cutting is "X2−D". The length obtained by subtracting F1 from this value is "X2−D−F1". Similarly to the above, the length d serving as a margin is subtracted from this length. Then, the position that equally divides the resulting length into two is set as the second folding position 80. In this way, F2 is set to be equal to "F1+(X2−D−F1−d)/2".

Although FIGS. 7A to 7C illustrate the example in which cutting is performed at three edges of the reference shape, cutting may be performed at one edge (end, for example).

When modifying the predetermined folding positions based on the folding style, the folding position setting unit 62 may calculate the modified folding positions by performing a calculation that is predetermined for each folding style as illustrated in FIGS. 7A to 7C or may set the folding positions by reading the modified folding positions stored in a predetermined table.

Also, in the example illustrated in FIGS. 7A to 7C, the folding position setting unit 62 changes both the first folding position 78 and the second folding position 80 of z-folding. However, because the folding position setting unit 62 modifies the folding position to a position of the recording medium that is not to be removed by cutting, the folding position setting unit 62 may modify the first folding position 78 alone as illustrated in FIGS. 8A to 8D.

Figure 8A:
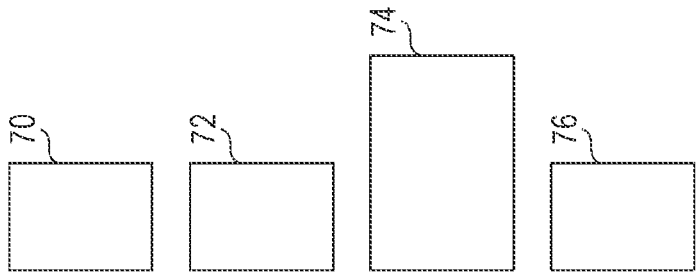
FIGS. 8A to 8D are schematic diagrams illustrating the case where a first folding position is modified but a second folding position is not during modification of folding positions of z-folding, specifically.
Figure 8B:
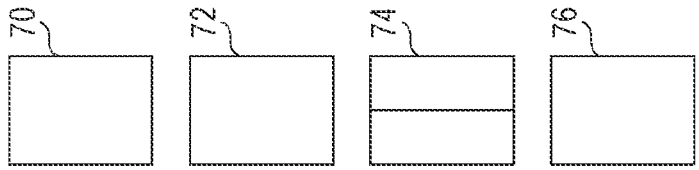
Figure 8C:
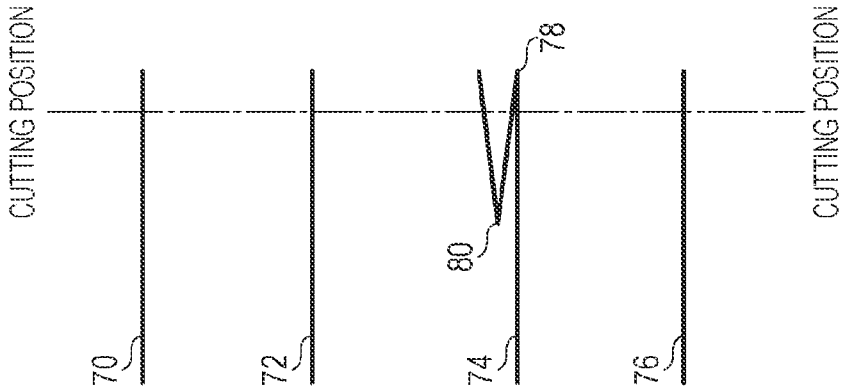
Figure 8D:
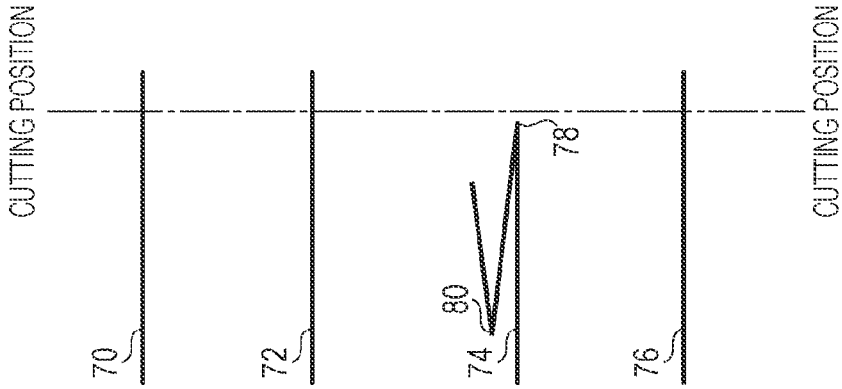

FIGS. 8A to 8D are schematic diagrams illustrating the case where the first folding position 78 is modified but the second folding position 80 is not during modification of folding positions of z-folding. Specifically, FIG. 8A is an elevational view illustrating an example of recording media to be cut as in FIG. 6A. FIG. 8B is an elevational view illustrating an example in which the sheet 74 is z-folded as in FIG. 6B. FIG. 8C is a plan view illustrating an example in which the sheet 74 is z-folded as in FIG. 6C. FIG. 8D is a plan view illustrating an example in which the sheet 74 is z-folded after the first folding position 78 alone is modified.

Although the case has been described above in which the folding position setting unit 62 sets the folding positions of z-folding, the folding position setting unit 62 may set folding positions of other folding styles in addition to z-folding.

For example, as illustrated in FIGS. 9A to 9D, the folding position setting unit 62 may set a folding position of bi-folding.

Figure 9A:
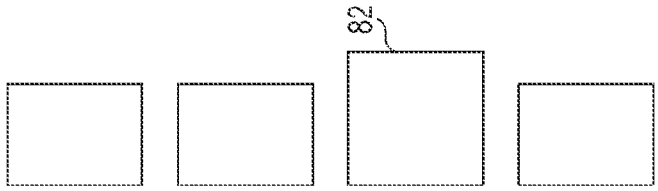
FIGS. 9A to 9D are schematic diagrams for describing how a folding position of bi-folding is modified by the folding position setting unit, specifically.
Figure 9B:
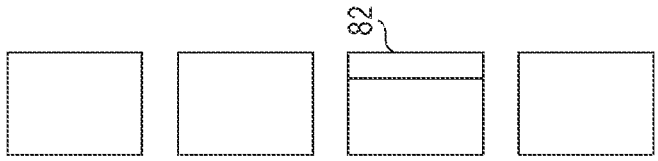
Figure 9C:
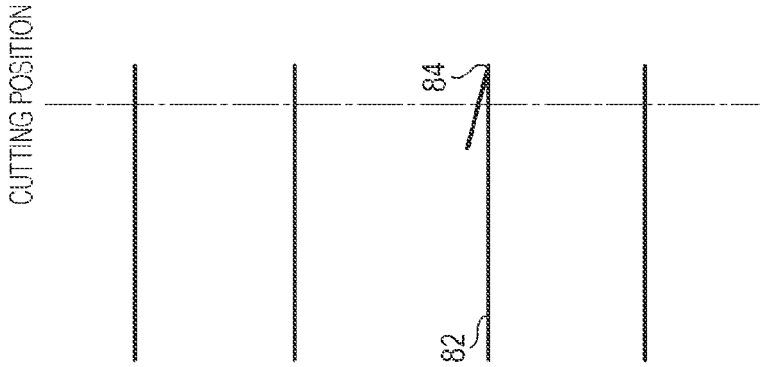
Figure 9D:
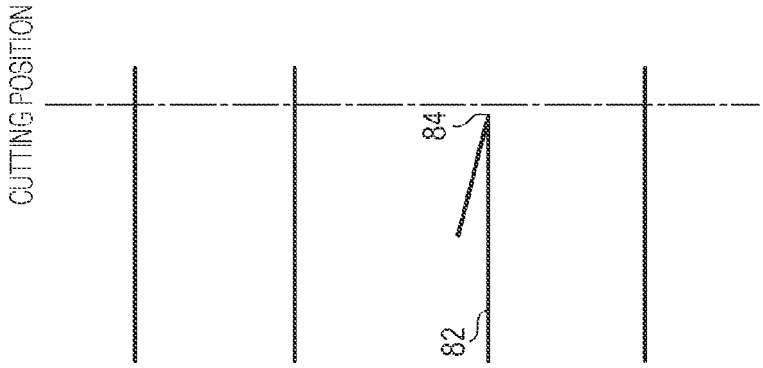

FIGS. 9A to 9D are schematic diagrams for describing how a folding position of bi-folding is modified by the folding position setting unit 62. Specifically, FIG. 9A is an elevational view illustrating an example of recording media to be cut as in FIG. 6A. FIG. 9B is an elevational view illustrating an example in which a sheet 82 is bi-folded. FIG. 9C is a plan view illustrating an example in which the sheet 82 is bi-folded at a predetermined folding position. FIG. 9D is a plan view illustrating an example in which the sheet 82 is bi-folded at a modified folding position.

As illustrated in FIGS. 9A and 9B, the case where the sheet 82 is bi-folded is taken as an example here. It is assumed that illustrated sheets are to be collectively bound at the left edges thereof in the figures. Also, as illustrated in FIGS. 9C and 9D, it is assumed that the sheet 82 is bi-folded in such a manner that the right side of the sheet 82 is folded toward the left side.

As illustrated in FIG. 9C, the sheet 82 is valley-folded at a folding position 84 (which is predetermined and at which the horizontal length of the sheet 82 is equal to that of other sheets in the example illustrated in FIGS. 9A to 9D).

In this case, the folding position 84 is included in an area to be removed as a result of cutting the sheet 82 at a cutting position illustrated in FIG. 9C. Thus, the folding position setting unit 62 modifies the folding position 84 to a position within an area not to be removed by cutting as illustrated in FIG. 9D.

Figure 10:
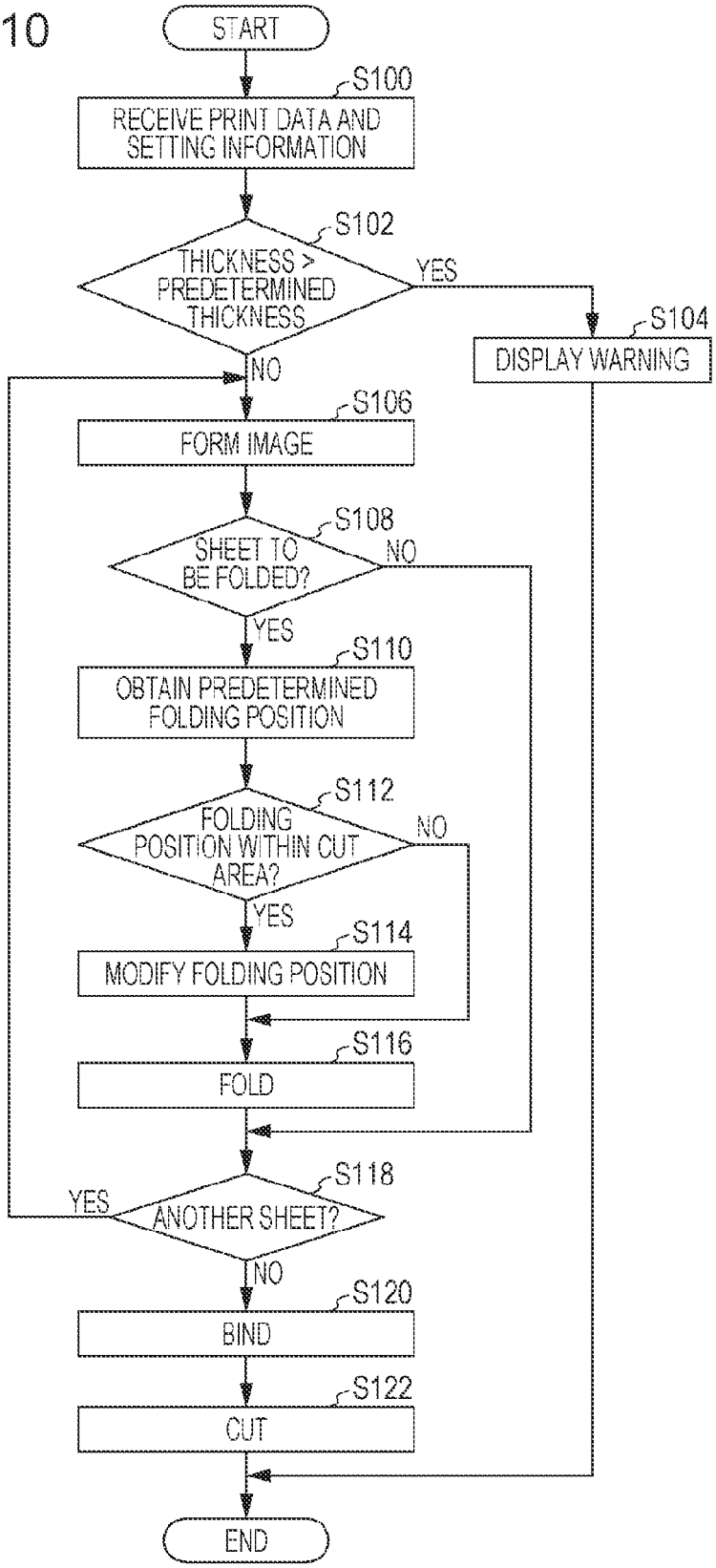
FIG. 10 is a flowchart illustrating an example of an operation performed by the recording medium processing system according to the first exemplary embodiment.

FIG. 10 is a flowchart illustrating an example of an operation performed by the recording medium processing system 2 according to the first exemplary embodiment.

In step S100, the recording medium processing system 2 receives print data and setting information. Here, the setting information includes, for example, information about a thickness of each recording medium to be used, in addition to the above-described information obtained by the setting information obtaining unit 60.

In step S102, the recording medium processing system 2 determines whether or not a thickness of the set of recording media exceeds the upper-limit thickness permitted in binding performed by the binding apparatus 8, on the basis of the information received in step S100. The binding apparatus 8 performs binding if the thickness of the set of recording media to be bound is less than or equal to a predetermined thickness. Here, the thickness of the set of recording media is calculated on the basis of the number of times each recording medium is folded. For example, in the case where a recording medium is z-folded by the recording medium folding apparatus 6, the recording medium is folded two times to have a thickness of three sheets. In this case, the thickness of the recording medium to be z-folded is calculated to be a thickness of three sheets. Then, it is determined whether or not the thickness of the set of recording media to be bound is less than or equal to the predetermined thickness. If the thickness of the set of recording media exceeds the predetermined thickness, the process proceeds to step S104; otherwise, the process proceeds to step S106.

In step S104, a warning indicating that the binding apparatus 8 is unable to perform binding is displayed on the UI device 38. The process then ends.

In step S106, the image forming apparatus 4 forms an image on a sheet, which is a recording medium, on the basis of the print data received in step S100. The sheet on which the image has been formed is transported to the recording medium folding apparatus 6.

In step S108, the recording medium folding apparatus 6 determines whether or not the sheet having undergone printing in step S106 is to be folded. If the sheet is a recorded medium to be folded, the process proceeds to step S110; otherwise, the process proceeds to step S118.

In step S110, the folding position setting unit 62 obtains predetermined folding positions for the specified folding style. For example, the folding position setting unit 62 obtains the predetermined folding positions by reading the predetermined folding positions from a table that stores predetermined folding positions for folding styles.

In step S112, the determining unit 64 determines whether or not a folding position which is predetermined for a folding style and at which the recording medium is to be folded is within an area to be removed by cutting. If the folding position is within the area to be removed by cutting, the process proceeds to step S114; otherwise, the folding position setting unit 62 instructs the folding unit 66 to fold the recording medium at the predetermined folding position and then the process proceeds to step S116.

In step S114, the folding position setting unit 62 modifies the folding position on the basis of the cutting position. The folding position setting unit 62 then instructs the folding unit 66 to fold the recording medium at the modified folding position.

In step S116, the folding unit 66 controls the folding processing mechanism unit 50 to fold the recording medium at the folding position that has been set by the folding position setting unit 62.

In step S118, it is determined whether or not an image is to be further formed on another sheet. If an image is to be further formed, the process returns to step S106 and the above-described steps are repeated. If folding of the sheets to be bound has been finished, the process proceeds to step S120.

In step S120, the binding apparatus 8 binds the set of sheets. For example, the binding apparatus 8 performs case binding to bind the set of sheets.

In step S122, the binding apparatus 8 performs cutting on the set of sheets that have been bound in step S120.

In the first exemplary embodiment above, the example has been described in which the determining unit 64 is provided as a component of the recording medium folding apparatus 6. However, the determining unit 64 may be provided as a component of the image forming apparatus 4. Also, in the first exemplary embodiment above, the configuration has been described in which the folding position setting unit 62 determines the folding position and instructs the folding unit 66 to fold the recording medium at the determined folding position. However, the function of determining the folding position may be implemented as a function of the image forming apparatus 4. In this case, for example, the image forming apparatus 4 may be configured to determine whether or not the predetermined folding position based on the folding style needs to be modified and configured to determine the folding position in accordance with this determination result. The recording medium folding apparatus 6 may be configured in such a manner that the setting information obtaining unit 60 obtains this determined folding position and the folding position setting unit 62 instructs the folding unit 66 to fold the recording medium at the obtained folding position. As described above, the folding position setting unit 62 has a function of just setting the folding position used by the recording medium folding apparatus 6, and thus need not determine the folding position.

Next, a second exemplary embodiment of the present invention will be described. In the first exemplary embodiment, recording media are folded by the recording medium folding apparatus 6. The second exemplary embodiment differs from the first exemplary embodiment in that recording media are manually folded by the user. In the second exemplary embodiment, the image forming apparatus 4 prints a mark indicating a fold on each recording medium to be folded.

Figure 11:
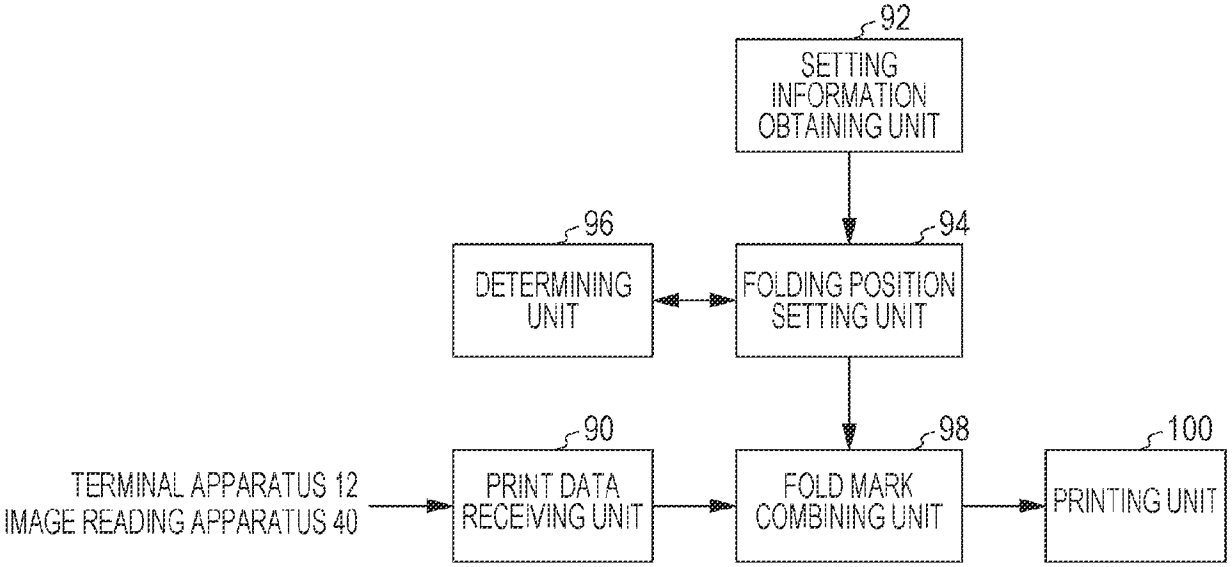
FIG. 11 is a block diagram illustrating the functional configuration of an image forming apparatus according to a second exemplary embodiment, the functional configuration being implemented as a result of execution of a control program.

FIG. 11 is a block diagram illustrating the functional configuration of the image forming apparatus 4 according to the second exemplary embodiment, the functional configuration being implemented as a result of execution of a control program. Note that the configuration illustrated in FIG. 11 may be entirely or partially implemented by hardware, such as an ASIC or FPGA.

As illustrated in FIG. 11, the image forming apparatus 4 includes a print data receiving unit 90, a setting information obtaining unit 92, a folding position setting unit 94, a determining unit 96, a fold mark combining unit 98, and a printing unit 100.

The print data receiving unit 90 receives print data from the terminal apparatus 12 or the image reading apparatus 40.

The setting information obtaining unit 92 obtains cutting position information used by the binding apparatus 8 during cutting, just like the setting information obtaining unit 60 of the first exemplary embodiment. The setting information obtaining unit 92 also obtains information that specifies an image subjected to folding among images that are to be formed on the basis of print data.

The folding position setting unit 94 sets a folding position of each recording medium on the basis of the cutting position obtained by the setting information obtaining unit 92, just like the folding position setting unit 62 of the first exemplary embodiment.

The determining unit 96 determines whether or not the predetermined folding position based on the folding style needs to be modified, just like the determining unit 64 of the first exemplary embodiment.

The fold mark combining unit 98 combines a fold mark image with an image subjected to folding among images that are to be printed on the basis of print data. At this time, the fold mark combining unit 98 combines a fold mark image at a position of the image corresponding to the folding position of the recording medium that has been set by the folding position setting unit 94.

Also, in the second exemplary embodiment, the fold mark combining unit 98 combines a fold mark image in such a manner that the fold mark image is to be printed for a folding position in an area to be removed from the recording medium by cutting and the fold mark image is not to be printed in an area not to be removed by cutting.

The printing unit 100 prints the fold mark image that has been combined by the fold mark combining unit 98 for an image subjected to folding. Specifically, for each recording medium on which an image subjected to folding is printed, the printing unit 100 prints a fold mark image at the folding position of the recording medium that has been set by the folding position setting unit 94. As described above, in the second exemplary embodiment, the printing unit 100 prints a fold mark image for the folding position in an area to be removed from the recording medium by cutting and does not print a fold mark image for the folding position in an area not to be removed from the recording medium by cutting. Also, for an image not subjected to folding, the printing unit 100 prints an image specified by print data on a recording medium.

Figure 12A:
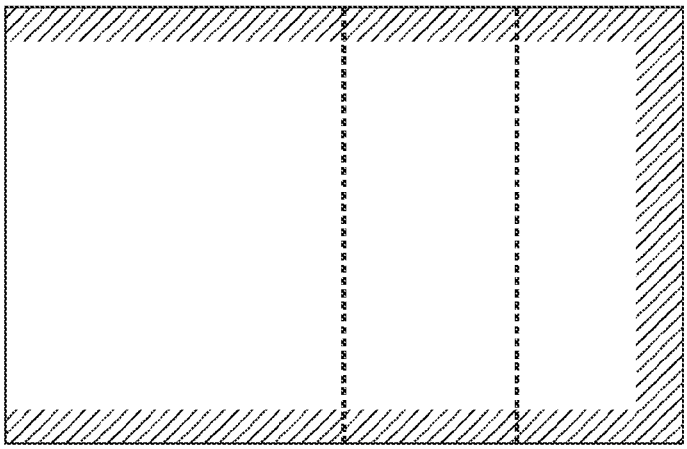
FIGS. 12A and 12B are schematic diagrams for describing how fold marks are printed, specifically.
Figure 12B:
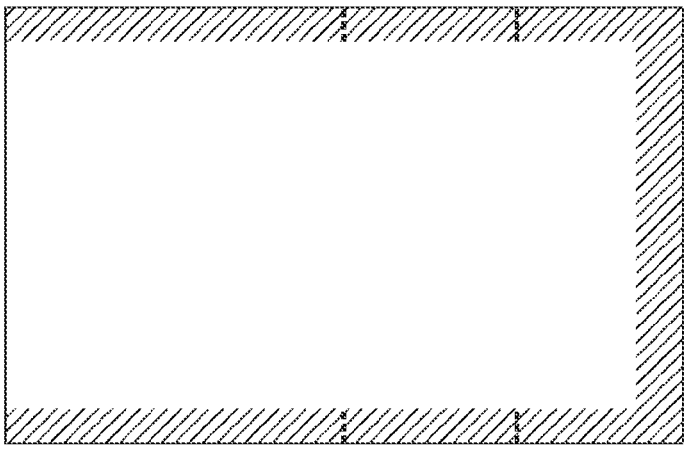

FIGS. 12A and 12B are schematic diagrams for describing how fold marks are printed. Specifically, FIG. 12A illustrates a comparative example, in contrast with fold marks printed in the second exemplary embodiment. FIG. 12B illustrates an example of fold marks printed in the second exemplary embodiment. A hatched area in the figures denotes an area to be removed from a recording medium by cutting. As illustrated in FIG. 12B, in the second exemplary embodiment, no fold mark (dotted line in the figures) is printed for the folding position in an area not to be removed from the recording medium by cutting.

Figure 13:
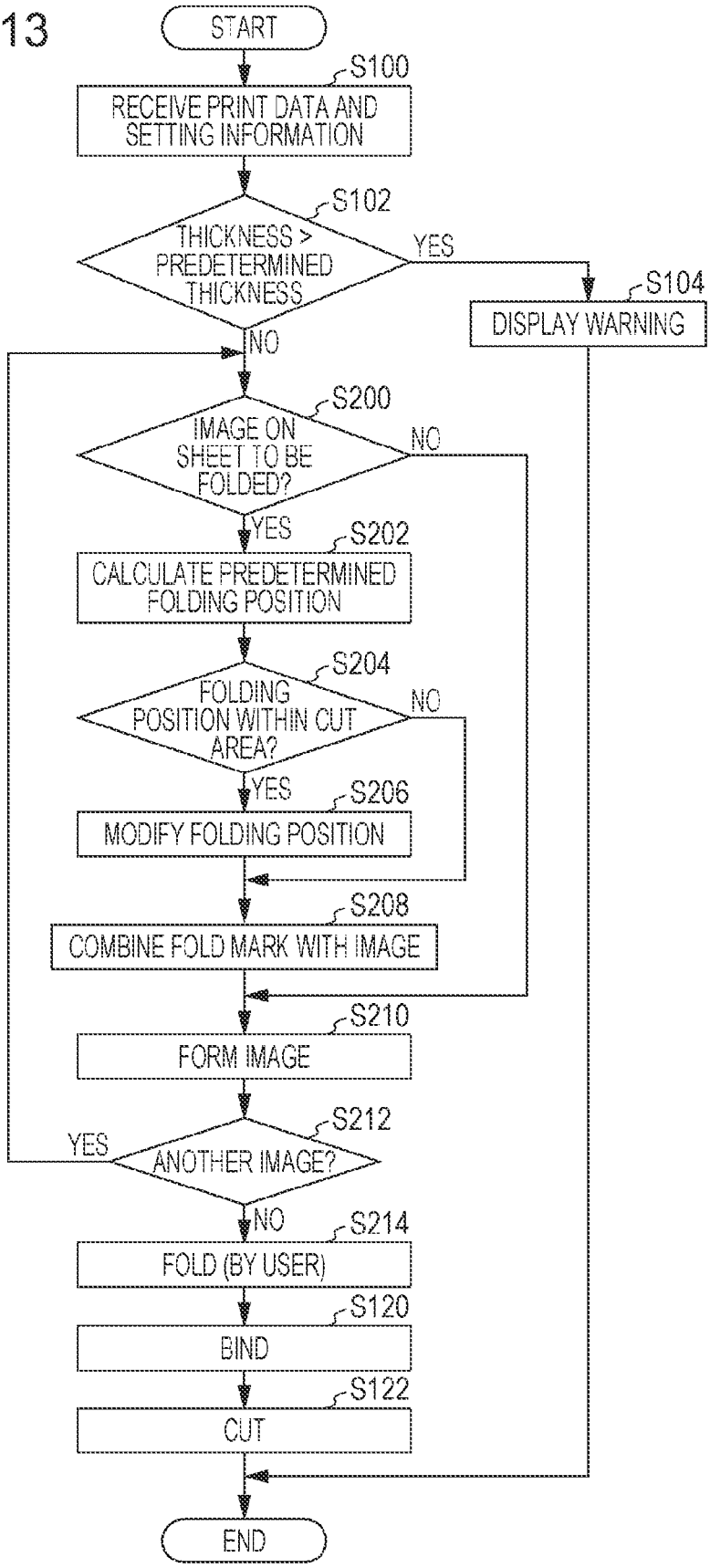
FIG. 13 is a flowchart illustrating an example of an operation performed by a recording media processing system according to the second exemplary embodiment.

FIG. 13 is a flowchart illustrating an example of an operation performed by the recording medium processing system 2 according to the second exemplary embodiment. Note that, in the second exemplary embodiment, recording media on which images have been formed by the image forming apparatus 4 are manually folded instead of using the recording medium folding apparatus 6, and then the set of recording media are supplied to and bound by the binding apparatus 8.

Because steps S100 to S104 are the same as those illustrated in FIG. 10, a description thereof is omitted in a description of the flowchart given below.

In step S200, the image forming apparatus 4 determines, for each image for which a print instruction is given in the print data, whether or not the image is subjected to folding. If the image is subjected to folding, the process proceeds to step S202; otherwise, the process proceeds to step S210.

In step S202, the folding position setting unit 94 obtains the predetermined folding position for the specified folding style.

In step S204, the determining unit 96 determines whether or not a folding position which is predetermined for a folding style and at which the recording medium is to be folded is within an area to be removed by cutting. If the folding position is within the area to be removed by cutting, the process proceeds to step S206; otherwise, the folding position setting unit 94 instructs the fold mark combining unit 98 to combine a fold mark at a position of the image corresponding to the predetermined folding position. Then, the process proceeds to step S208.

In step S206, the folding position setting unit 94 modifies the folding position on the basis of the cutting position. The folding position setting unit 94 then instructs the fold mark combining unit 98 to combine a fold mark at a position of the image corresponding to the modified folding position.

In step S208, the fold mark combining unit 98 combines a fold mark image with the image for which a print instruction is given in the print data.

In step S210, the printing unit 100 prints, for each image subjected to folding, the fold mark image that has been combined by the fold mark combining unit 98 on a recording media, and prints, for each image not subjected to folding, an image specified in the print data on a recording medium.

In step S212, it is determined whether or not there is another image for which a print instruction is given in the print data. If there is another image, the process returns to step S200 and the above-described steps are repeated. If there is no other image, the process proceeds to step S214.

In step S214, the user manually folds the resulting recording media with reference to the fold marks, and then supplies the recording media to the binding apparatus 8. Thereafter, the binding apparatus 8 performs binding in step S120 and cutting in step S122.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium processing apparatus comprising:

a folding position setting unit configured to set, using a cutting position at which a recording medium is to be cut, a folding position at which the recording medium is to be folded;

a folding unit configured to fold the recording medium at the folding position that has been set by the folding position setting unit; and a determining unit configured to determine whether or not the folding position at which the recording medium is to be folded is within an area to be removed by cutting, wherein the folding position setting unit is configured to, in response to the determining unit determining that the folding position is within the area to be removed by cutting, modify, using the cutting position, the folding position.

2. A recording medium processing apparatus according to claim 1, further comprising:

a printing unit configured to print a fold mark at the folding position on the recording medium, the folding position having been set by the folding position setting unit.

3. The recording medium processing apparatus according to claim 2, wherein the printing unit prints the fold mark at the folding position in an area to be removed from the recording medium by cutting.

4. A recording medium processing system comprising:

an image forming apparatus configured to form an image on a recording medium;

a recording medium folding apparatus including:

a folding position setting unit configured to set, using a cutting position at which a recording medium is to be cut, a folding position at which the recording medium is to be folded;

a folding unit configured to fold the recording medium on which the image has been formed by the image forming apparatus, at the folding position that has been set by the folding position setting unit; and a determining unit configured to determine whether or not the folding position at which the recording medium is to be folded is within an area to be removed by cutting, wherein the folding position setting unit is configured to, in response to the determining unit determining that the folding position is within the area to be removed by cutting, modify, using the cutting position, the folding position; and a binding apparatus configured to bind a set of recording media which have a thickness less than or equal to a predetermined thickness, the binding apparatus including:

a cutting unit configured to cut, at the cutting position, recording media that have been folded by the recording medium folding apparatus.

5. The recording medium processing system according to claim 4, wherein the binding apparatus is configured to bind the set of recording media in response to a thickness of the set of recording media to be bound, the thickness being calculated using the number of times that each recording medium among the set of recording media has been folded by the recording medium folding apparatus, being less than or equal to the predetermined thickness.

6. A non-transitory computer readable medium storing a program causing a computer to execute a process for recording medium processing, the process comprising:

setting, using a cutting position at which a recording medium is to be cut, a folding position at which the recording medium is to be folded;

controlling a folding unit to fold the recording medium at the folding position that has been set; and determining whether or not the folding position at which the recording medium is to be folded is within an area to be removed by cutting, wherein the setting comprises, in response to determining that the folding position is within the area to be removed by cutting, modifying, using the cutting position, the folding position.

7. The non-transitory computer readable medium according to claim 6, wherein the process further comprises:

printing a fold mark at the folding position on the recording medium, the folding position having been set by the setting.

8. The non-transitory computer readable medium according to claim 7, wherein the printing comprises:

printing the fold mark at the folding position in an area to be removed from the recording medium by cutting.

* * * * *